US009671205B1

(12) United States Patent
Wei

(10) Patent No.: US 9,671,205 B1
(45) Date of Patent: Jun. 6, 2017

(54) PORTABLE BULLET RECEIVING DEVICE

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 15/231,866

(22) Filed: Aug. 9, 2016

(51) Int. Cl.
*F41A 15/00* (2006.01)
*F41A 15/02* (2006.01)
*F42B 39/02* (2006.01)

(52) U.S. Cl.
CPC ..... *F42B 39/02* (2013.01)

(58) Field of Classification Search
CPC ..... F42B 39/00; F42B 39/02; F41A 15/00; F41A 15/02
USPC ..... 224/242, 251, 931
See application file for complete search history.

(56) References Cited

U.S. PATENT DOCUMENTS 2,396,184 A * 3/1946 Lima ..... F41A 9/85 206/3
2,457,262 A * 12/1948 Norquist ..... B65D 85/20 206/3
3,722,125 A * 3/1973 Switzer ..... F41A 9/85 42/89
4,065,868 A * 1/1978 Johnson ..... F41A 9/85 42/89
4,572,415 A * 2/1986 Fehr ..... F41A 9/85 224/675
4,666,034 A * 5/1987 Johnson ..... F42B 39/00 206/3
4,796,371 A * 1/1989 Daniels ..... F41A 9/85 42/89
5,341,587 A * 8/1994 Phillips, Jr. ..... F41A 15/02 42/68
5,953,845 A * 9/1999 Longwitz ..... F41A 9/85 42/89
6,095,026 A * 8/2000 Poussard ..... F41F 1/06 89/1.3
6,688,504 B1 * 2/2004 Kirkaldy ..... A45F 5/021 224/196
7,431,057 B2 * 10/2008 Ryan ..... F41A 9/82 124/41.1
7,975,420 B2 * 7/2011 Pestana ..... F41A 9/63 224/931
8,136,285 B2 * 3/2012 Abell ..... F41A 9/85 224/198
8,549,978 B2 * 10/2013 Chiappini ..... F41A 9/26 89/1.805

(Continued)

*Primary Examiner* — Brian D Nash
(74) *Attorney, Agent, or Firm* — Chun-Ming Shih; HDLS IPR Services

(57) ABSTRACT

A portable bullet receiving device is for receiving a plurality of bullet sets (50). The portable bullet receiving device includes a base (110), an assembly pillar (120) and a retaining member (170). The assembly pillar (120) is vertically connected to the base (110). The assembly pillar (120) includes two holes (122) opposite to each other and an opening (124). The retaining member (170) is movably installed at the opening (124) of the assembly pillar (120). The retaining member (170) includes a support portion (172), two arms (180) connected to one side of the support portion (172), and a flexible element (200) in contact with the other side of the support portion (172). Two end portions of the two arms (180) movably protrude out of the two holes (122) and restrict the bullet set (50) from being removed from the assembly pillar (120), thereby achieving rapid loading of bullets (10).

15 Claims, 7 Drawing Sheets

(56) References Cited

U.S. PATENT DOCUMENTS

| | | | | |
|---|---|---|---|---|
| 9,103,613 | B2 * | 8/2015 | Hayes | F41A 9/61 |
| 2006/0101698 | A1 * | 5/2006 | Lin | F41A 9/85<br>42/89 |
| 2014/0082984 | A1 * | 3/2014 | Kent | F41A 9/83<br>42/88 |

* cited by examiner

PORTABLE BULLET RECEIVING DEVICE

TECHNICAL FIELD

The present invention relates to a bullet receiving device and, in particular, to a portable bullet receiving device for rapid loading of bullets.

BACKGROUND

War games are outdoor exercise which needs not only stamina and perseverance, but also teamwork and rapport. Therefore, war games are healthy activities for everyone to participate in to reduce his/her stress and develop potential abilities.

In war games, players use airsoft guns collaborating with airsoft bullets to simulate real wars for realistic experiences. However, after all bullets are fired, the player needs to take out the cylinder to load bullets one by one into the same. However, this loading method is slow, troublesome and time-consuming, so there is a need to solve this problem and achieve rapid loading of the bullets.

Accordingly, the inventor made various studies to solve the above-mentioned problem, on the basis of which the present invention is accomplished.

SUMMARY

It is an object of the present invention to provide a portable bullet receiving device for rapid loading of bullets.

Accordingly, the present invention provides a portable bullet receiving device for receiving a plurality of bullet sets. The portable bullet receiving device includes a base, an assembly pillar and a retaining member. The assembly pillar is vertically connected to the base. The assembly pillar includes two holes opposite to each other and an opening. The retaining member is movably installed at the opening of the assembly pillar. The retaining member includes a support portion, two arms connected to one side of the support portion, and a flexible element in contact with the other side of the support portion. An end portion of each of the two arms movably protrudes out of each of the two holes and restricts the bullet set from being removed from the assembly pillar.

It is preferable that the retaining member further includes a rod, a head connected to the rod, and an insertion element configured to be received by the flexible element.

It is preferable that the two arms are symmetrically disposed at two sides of the rod, and each of the arms includes an extension portion and a block portion connected to the extension portion.

It is preferable that the head includes a first end and a second end connected to the first end, and the first end is connected to the rod.

It is preferable that the two block portions movably protrude out of the two holes or retract into the assembly pillar.

It is preferable that the second end has a larger outer diameter than an outer diameter of the first end and an outer diameter of the assembly pillar.

It is preferable that the support portion, the two arms, the rod, and the head are integrally formed, and the retaining member consists of plastic.

It is preferable that the assembly pillar includes a contact portion in contact with the flexible element.

It is preferable that two ends of the flexible element contact the contact portion and the support portion respectively, and the flexible element is a compression spring.

It is preferable that the assembly pillar further includes a connection pillar, and the connection pillar is disposed between the base and the assembly pillar.

The assembly pillar is preferably a hollow column.

The assembly pillar preferably consists of metal or alloy thereof.

It is preferable that one end of the base includes a side plate and a board connected to a top end of the side plate.

It is preferable that a gap is formed between the side plate and the board.

It is preferable that a height of the side plate is lower than or close to a height of the assembly pillar, and the board is parallel to the side plate.

The present invention further provides the following functions. Since one end of the base is connected to the side plate, and a top end of the side plate parallel to the board is connected to the board, so that the present invention can be hung on a belt, equipment, or other suitable place of a player/operator, and thereby the present invention can be carried around with ease. The portable bullet receiving device of the present invention has a simple structure, and is light and can be manufactured easily, so it is not troublesome at all for the player to add the present invention into his equipment.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
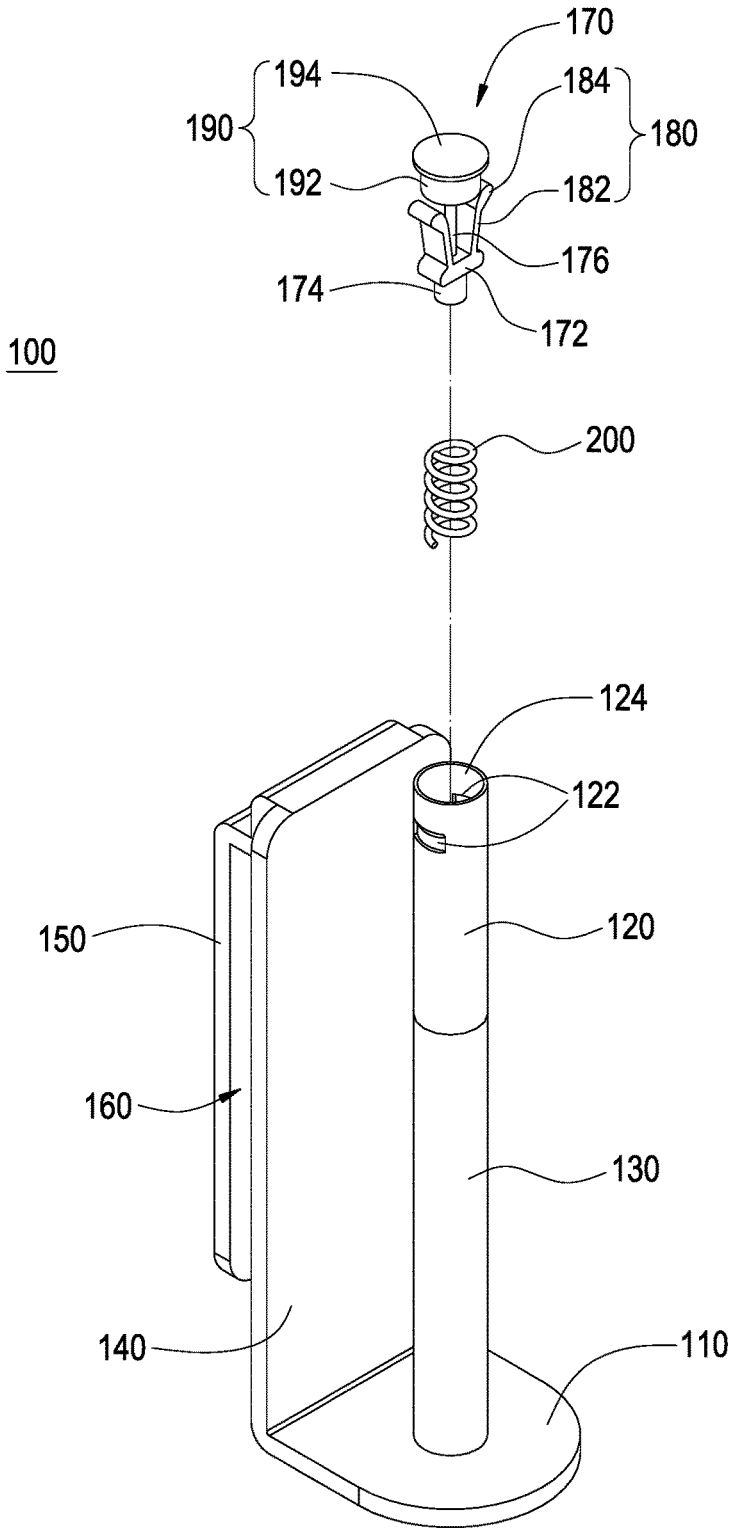
FIG. 1 is an exploded view of the present invention, showing a portable bullet receiving device.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 5, the present invention provides a portable bullet receiving device 100 for receiving a plurality of bullet sets 50. According to the present embodiment, the bullet receiving device 100 includes a base 110, an assembly pillar 120 and a retaining member 170.

Figure 4:
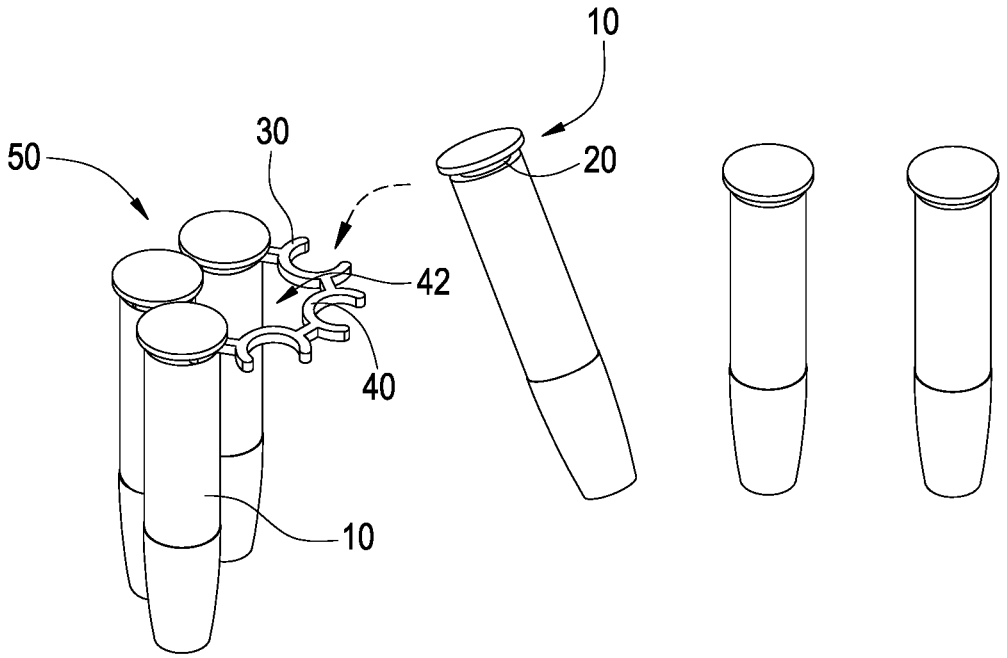
FIG. 4 is an exploded view of the present invention, showing a single bullet set.

The plurality of bullet sets 50 are preferably made of plastic or suitable materials to form a plurality of sets of bullet rings 30 clamping a plurality of simulated bullets 10, for example, six bullets. The number of the bullets 10 of the bullet rings 30 varies according to how many bullets 10 a cylinder (not illustrated) of a toy gun can contain; however, the present invention is not limited in this regard. As shown in FIG. 4, the bullet ring 30 preferably includes a plurality of circular fasteners 40 and an aperture 42. Each circular fastener 40 40 is configured to engage and fasten a recess 20 of each bullet 10. Then, by means of the aperture 42, the bullet ring 30 receives the assembly pillar 120, so that each bullet set 50 can be loaded at one time in the cylinder (not illustrated) of the toy gun.

Figure 2:
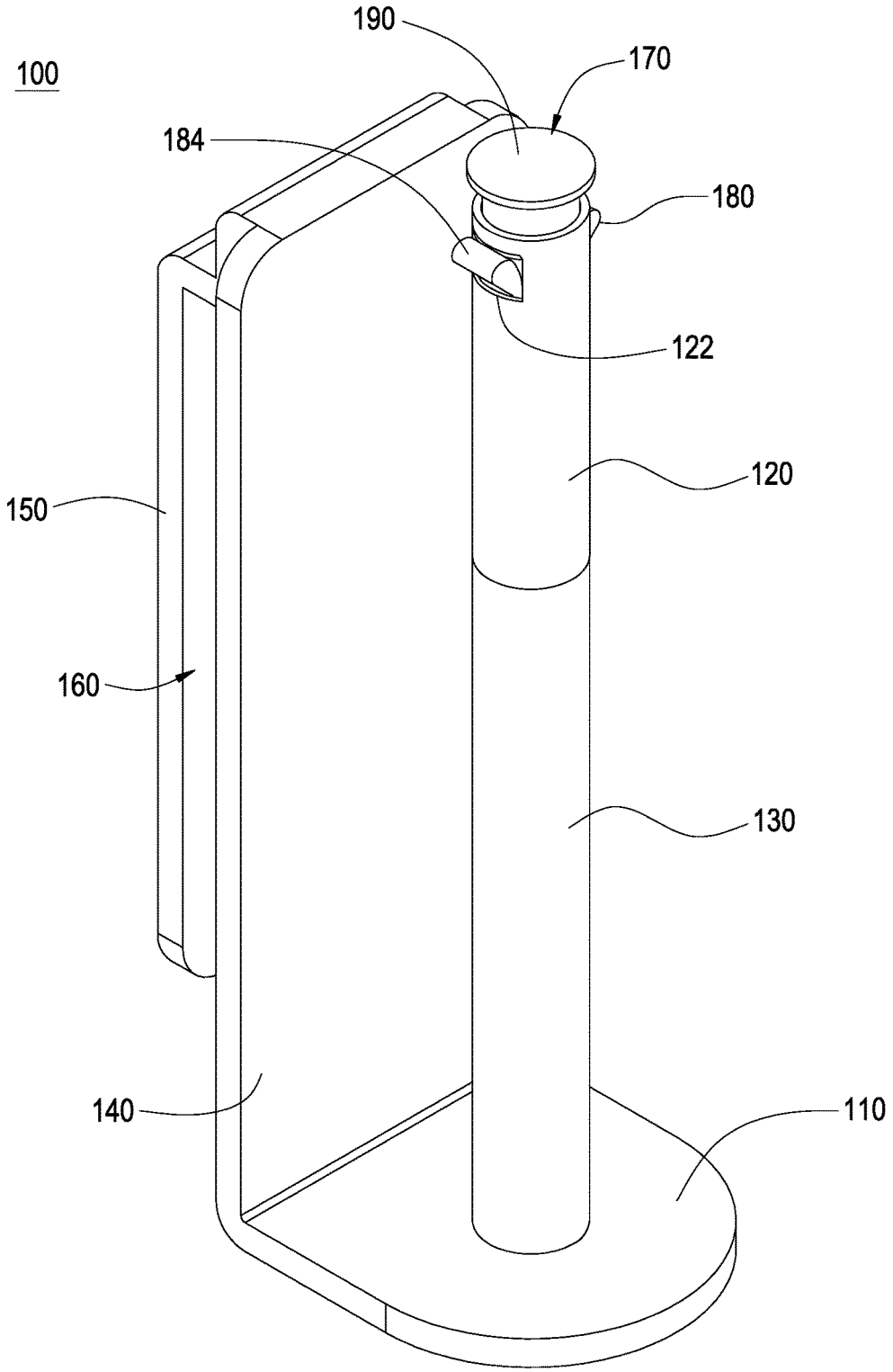
FIG. 2 is a perspective view of the present invention, showing the portable bullet receiving device.

As shown in FIGS. 1 and 2, the assembly pillar 120 is vertically connected to the base 110. A top end of the assembly pillar 120 includes two holes 122 opposite to each other and an opening 124. As shown in the drawings, the base 110 is preferably a flat plate made of plastic or similar materials. The assembly pillar 120 is a hollow column made of metal or alloy thereof to prolong its lifespan.

Figure 5:
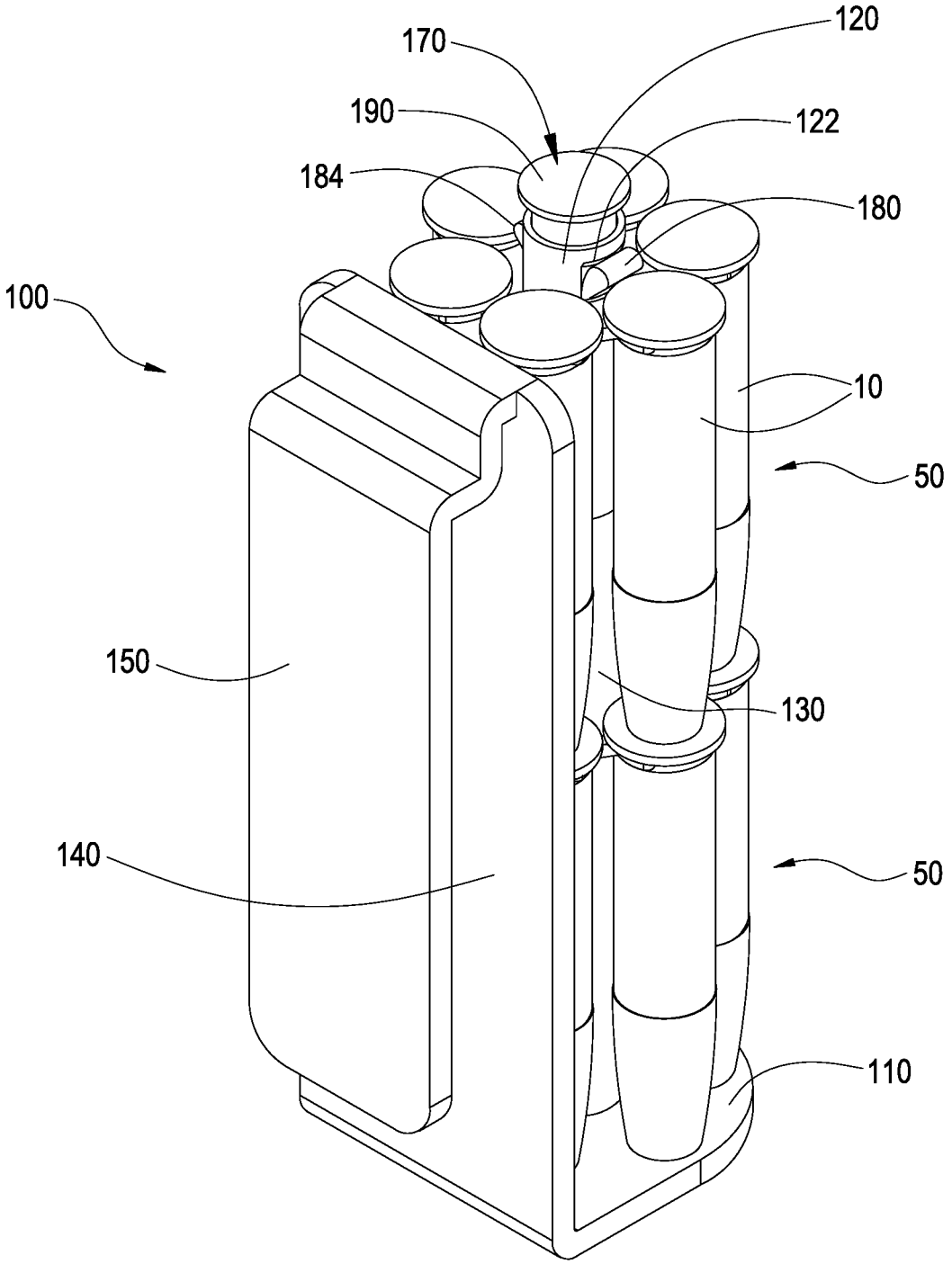
FIG. 5 is a perspective view of the present invention, showing that multiple bullet sets are received in the portable bullet receiving device.

The retaining member 170 is movably installed at the opening 124 of the assembly pillar 120. The retaining member 170 includes a support portion 172, two arms 180 connected to one side of the support portion 172, and a flexible element 200 in contact with the other side of the support portion 172. An end portion of each of the two arms 180 movably protrudes out of each of the two holes 122 and restricts the bullet set 50 from being removed from the assembly pillar 120, as shown in FIG. 5.

The retaining member 170 includes a rod 176, a head 190 connected to the rod 176, and an insertion element 174 configured to be received by the flexible element 200. In the embodiment shown in FIG. 1, the insertion element 174 is protrudingly disposed on one side of the support portion 172, and is columnar. The two arms 180 are symmetrically disposed at two sides of the rod 176, and each of the arms 180 includes an extension portion 182 and a block portion 184 connected to the extension portion 182. When the two block portions 184 of the two arms 180 are installed in the two holes 122 of the assembly pillar 120 respectively, the two block portions 184 movably protrude out of the two holes 122 or retract into the assembly pillar 120 upon the action of the flexible element 200.

Figure 6:
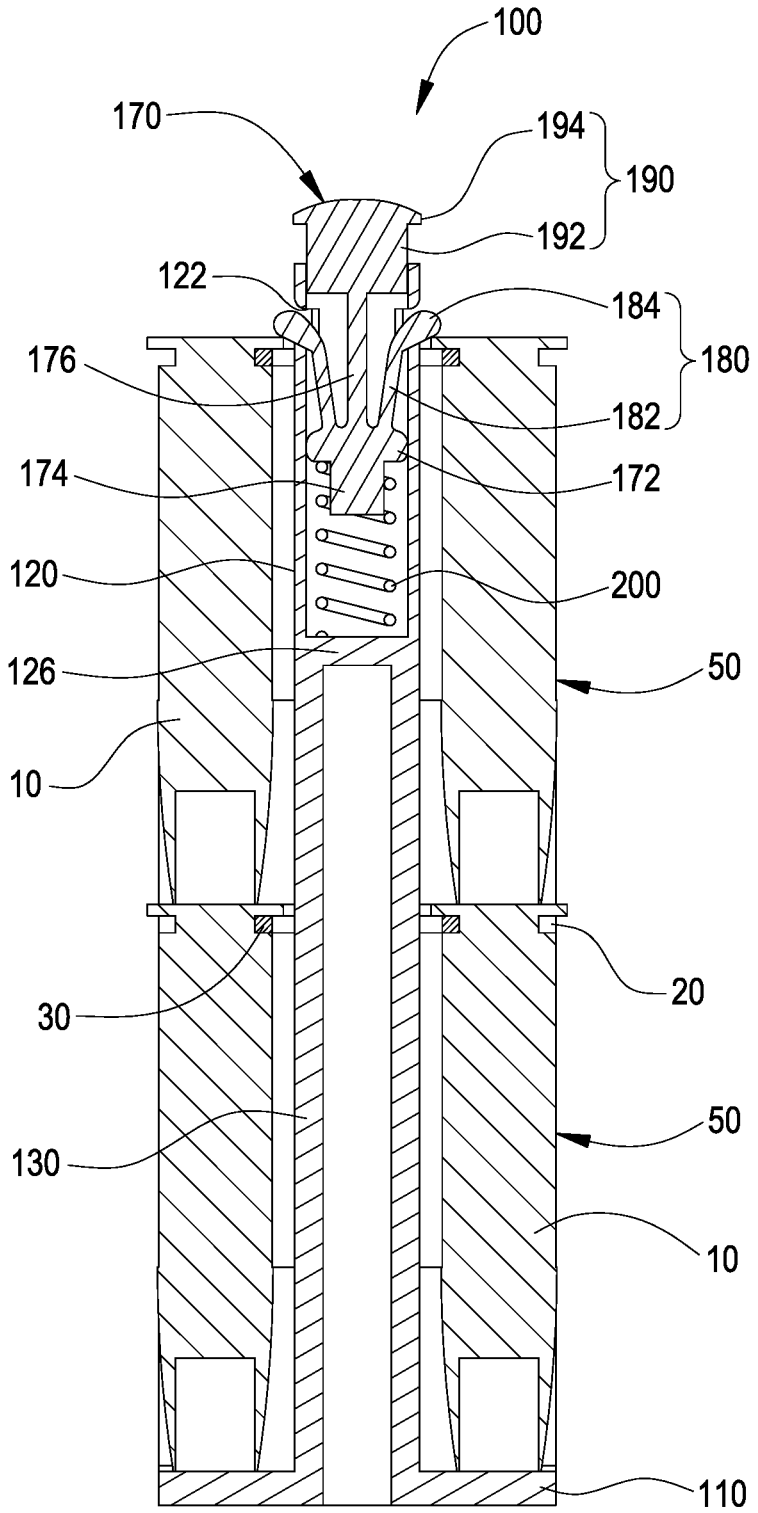
FIG. 6 is a cross-sectional view of the present invention, showing that multiple bullet sets are received in the portable bullet receiving device.
Figure 7:
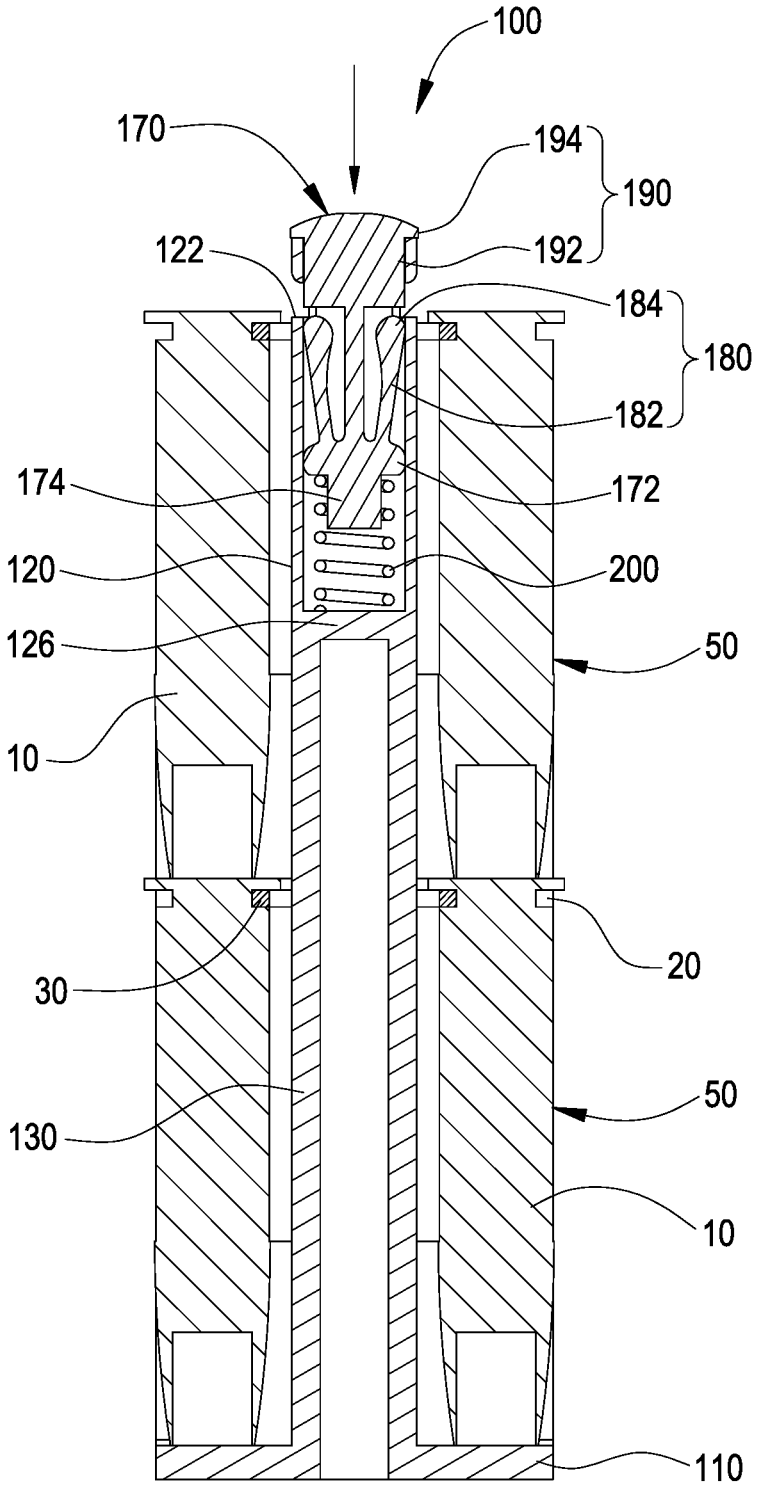
FIG. 7 is another cross-sectional view of the present invention, showing that multiple bullet sets are received in the portable bullet receiving device.

The head 190 which is columnar in shape includes a first end 192 and a second end 194 connected to the first end 192, and the first end 192 is connected to the rod 176. Referring to FIG. 6 and FIG. 7, the second end 194 has a larger outer diameter than an outer diameter of the first end 192 and an outer diameter of the assembly pillar 120, so that when the retaining member 170 moves toward the assembly pillar 120, the second end 194 is blocked by the assembly pillar 120, thereby providing a restriction effect.

The assembly pillar 120 further includes a contact portion 126, such as a bottom, in contact with the flexible element 200, so that two ends of the flexible element 200 is respectively in contact with the contact portion 126 and the support portion 172 between them. As shown in the drawings, the flexible element 200 is preferably a compression spring or other suitable spring for providing flexibility to restore the retaining member 170 to its original position. Furthermore, the assembly pillar 120 further includes a connection pillar 130. The connection pillar 130 is disposed between the base 110 and the assembly pillar 120 to increase a height of the assembly pillar 120.

A total height of the assembly pillar 120 and the connection pillar 130 connected together may vary depending on how many bullet sets 50 should be received. In the embodiment shown in FIG. 5, the total height of the assembly pillar 120 and the connection pillar 130 is suitable for receiving two bullet sets 50, as an example. The base 110 and the connection pillar 130 are preferably made of plastic or similar materials to reduce a weight of the bullet receiving device 100.

One end of the base 110 includes a side plate 140 and a board 150 connected to a top end of the side plate 140. A gap 160 is formed between the side plate 140 and the board 150, so that the bullet receiving device 100 can be hung on a user's belt (not illustrated), equipment (not illustrated) with ease, or other suitable place, and thereby a new bullet set 50 can be loaded quickly when there are no bullets 10 left. Furthermore, a height of the side plate 140 is lower than or close to the height of the assembly pillar 120 (in conjunction with the connection pillar 130), and the board 150 is parallel to the side plate 140.

Figure 3:
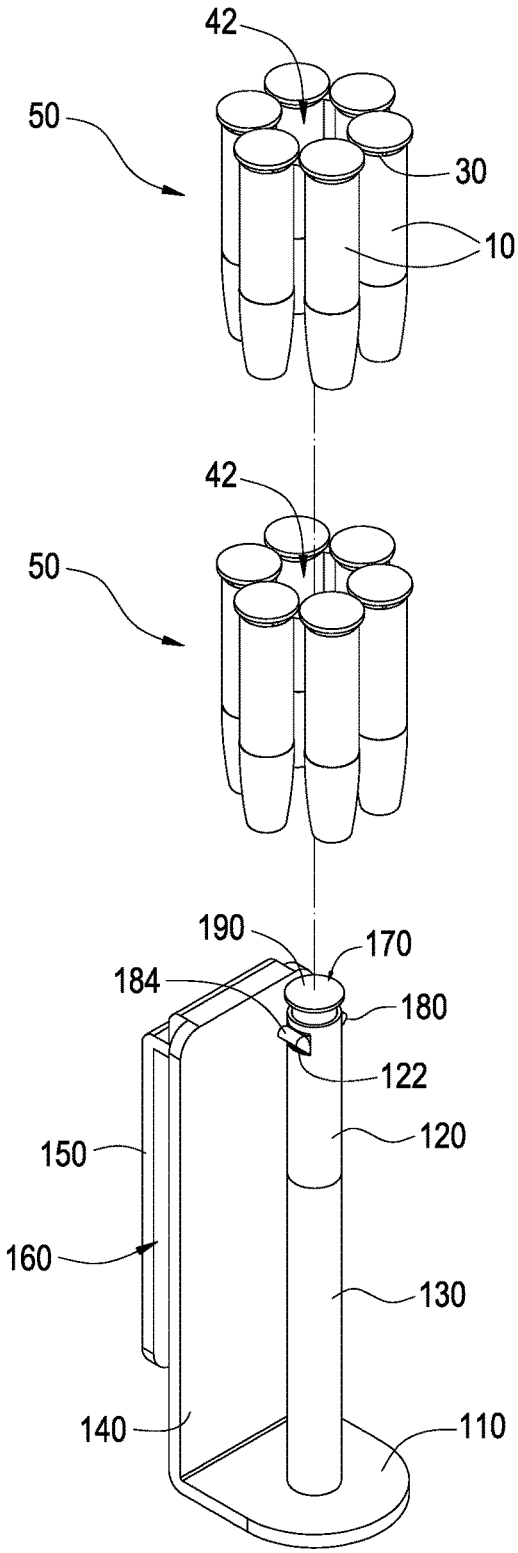
FIG. 3 is a perspective view of the present invention, showing a plurality of bullet sets being received in the portable bullet receiving device.

The following describes how the bullet set 50 is assembled to or disassembled from the bullet receiving device 100. As shown in FIGS. 3, 5, and 7, when to assemble multiple bullet sets 50 in the bullet receiving device 100, the retaining member 170 is pressed at the same time to move toward the assembly pillar 120, and two block portions 184 retract into the assembly pillar 120 from the two holes 122. At this point, the aperture 42 of each bullet set 50 is brought to pass through the block portion 184 to be positioned on the assembly pillar 120. When the head 190 of the retaining member 170 is released, the flexible element 200 recoils to return the retaining element 170 to its original position. At this moment, the two block portions 184 of the two arms 180 protrude out of the two holes 122 again from the retaining member 170 to block a top of each bullet 10.

In the embodiment shown in FIG. 6 and FIG. 7, when to take out the bullet set 50 from the bullet receiving device 100, the retaining member 170 is pressed to move toward the assembly pillar 120, so that two block portions 184 retract into the assembly pillar 120 from the two holes 122. At this point, the bullet set 50 can be taken out from the assembly pillar 120 to be loaded into the cylinder (not illustrated) of the toy gun. Accordingly, the bullet receiving device 100 of the present invention has a simple structure, and is light and can be manufactured easily, so it is not troublesome at all for a player to add the bullet receiving device 100 into his equipment.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A portable bullet receiving device (100), for receiving a plurality of bullet sets (50), comprising:

a base (110);

an assembly pillar (120), the assembly pillar (120) being vertically connected to the base (110), the assembly pillar (120) including two holes (122) opposite to each other and an opening (124); and a retaining member (170), the retaining member (170) being movably installed at the opening (124) of the assembly pillar (120), the retaining member (170) including a support portion (172), two arms (180) connected to two vertically opposite sides of the support portion (172), respectively, and a flexible element (200) in contact with the other side of the support portion (172), wherein an end portion of each of the two arms (180) movably protrudes out of each of the two holes (122) and restricts the bullet sets (50) from being removed from the assembly pillar (120).

2. The portable bullet receiving device of claim 1, wherein the retaining member (170) further includes a rod (176), a head (190) connected to the rod (176), and an insertion element (174) configured to be received by the flexible element (200).

3. The portable bullet receiving device of claim 2, wherein the two arms (180) are symmetrically disposed at two sides of the rod (176), respectively, and each of the two arms (180) includes an extension portion (182) and a block portion (184) connected to the extension portion (182).

4. The portable bullet receiving device of claim 3, wherein the two block portions (184) movably protrude out of the two holes (122) or retract into the assembly pillar (120).

5. The portable bullet receiving device of claim 2, wherein the head (190) includes a first end (192) and a second end (194) connected to the first end (192), and the first end (192) is connected to the rod (176).

6. The portable bullet receiving device of claim 5, wherein the second end (194) has a larger outer diameter than an outer diameter of the first end (192) and an outer diameter of the assembly pillar (120).

7. The portable bullet receiving device of claim 1, wherein the support portion (172), the two arms (180), the rod (176) and the head (190) are integrally formed, and the retaining member (170) is made of plastic.

8. The portable bullet receiving device of claim 1, wherein the assembly pillar (120) includes a contact portion (126) in contact with the flexible element (200).

9. The portable bullet receiving device of claim 8, wherein the flexible element (200) is disposed between the contact portion (126) and the support portion (172), two ends of the flexible element (200) are in contact with the contact portion (126) and the support portion (172) respectively, and the flexible element (200) is a compression spring.

10. The portable bullet receiving device of claim 1, wherein the assembly pillar (120) further includes a connection pillar (130), and the connection pillar (130) is disposed between the base (110) and the assembly pillar (120).

11. The portable bullet receiving device of claim 1, wherein the assembly pillar (120) is a hollow column.

12. The portable bullet receiving device of claim 1, wherein the assembly pillar (120) is made of metal or alloy.

13. The portable bullet receiving device of claim 1, wherein one end of the base (110) includes a side plate (140) and a board (150) connected to a top end of the side plate (140).

14. The portable bullet receiving device of claim 13, wherein a gap (160) is formed between the side plate (140) and the board (150).

15. The portable bullet receiving device of claim 13, wherein a height of the side plate (140) is lower than or close to a height of the assembly pillar (120), and the board (150) is parallel to the side plate (140).

* * * * *